US006745883B2

(12) United States Patent
Eto et al.

(10) Patent No.: US 6,745,883 B2
(45) Date of Patent: Jun. 8, 2004

(54) ELECTRIC POWER TOOL

(75) Inventors: Yasuo Eto, Ibaraki (JP); Hideki Kurosawa, Ibaraki (JP); Yoshiaki Adachi, Ibaraki (JP); Kenichi Takaada, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/321,556

(22) Filed: Dec. 18, 2002

(65) Prior Publication Data

US 2003/0178280 A1 Sep. 25, 2003

(30) Foreign Application Priority Data

Mar. 20, 2002 (JP) ..... P2002-079173

(51) Int. Cl.[7] ..... B25B 23/14

(52) U.S. Cl. ..... 192/56.62; 192/95; 192/110 R; 173/178

(58) Field of Search ..... 192/56.57, 56.62, 192/95, 110 R; 464/36; 173/178; 74/553, 558; 16/430, 432, 433, DIG. 30

(56) References Cited

U.S. PATENT DOCUMENTS

| | | | | | |
|---|---|---|---|---|---|
| 2,610,877 | A | * | 9/1952 | Weaver | 292/1 |
| 5,450,653 | A | * | 9/1995 | Howie, Jr. | 16/441 |
| 5,469,758 | A | * | 11/1995 | Howie, Jr. | 74/553 |
| 6,045,303 | A | * | 4/2000 | Chung | 408/124 |
| 6,142,242 | A | * | 11/2000 | Okumura et al. | 173/48 |
| 6,595,300 | B2 | * | 7/2003 | Milbourne | 173/170 |

* cited by examiner

*Primary Examiner*—Richard M. Lorence
(74) *Attorney, Agent, or Firm*—McGinn & Gibb, PLLC

(57) ABSTRACT

In an electric power tool having a clutch ring for adjusting a fastening torque, an outer member 3 which are lower in hardness than a base member 2 of the clutch ring 1 has a plurality of projections discontinuously arranged on the outer peripheral face of the base member 2.

7 Claims, 6 Drawing Sheets

ELECTRIC POWER TOOL

BACKGROUND OF THE INVENTION

1. Field of the Invention

The present invention relates to an electric power tool in which a fastening torque is adjustable, such as a driver or a driver drill.

2. Description of the Related Art

In a conventional electric power tool of this kind, a clutch ring which is a part for adjusting the fastening torque is rotatably disposed on the body of the electric power tool, so that the fastening torque can be adjusted by rotating the clutch ring.

Such a clutch ring is requested to have a mechanical strength against an external force. Therefore, a conventional clutch ring is made of a hard synthetic resin such as polyamide (PA), polycarbonate (PC), or a material in which glass fibers are added to such a resin. A plurality of convex or concave portions are disposed in the circumferential direction on the outer peripheral face for the principal purpose of enhancing the antislipping function. Furthermore, characters or icons which indicate the adjustment state of the fastening torque of the electric power tool are printed on the outer peripheral face. In order to prevent the characters or icons from being defaced as result of use, recently, the character or icon portion is sometimes formed by two-color molding with using a hard synthetic resin of the same kind as that of the clutch ring.

A torque adjusting mechanism of an electric power tool having a clutch ring of this kind will be described with reference to FIG. 8. A pinion 10 which is fixed to a motor shaft 9 to be driven thereby meshes with planet gears A 12 which are supported by support shafts 11*b* of a carrier A 11, and which mesh with an internal gear A 14 fixed to a gear case A 13. In the carrier A 11, a sun gear A 11*a* is formed as the next stage. The sun gear A 11*a* meshes with planet gears B 17 which are supported by support shafts 15*b* of a carrier C 15, and which mesh with an internal gear B 16. The power of the motor shaft 9 is reducingly transmitted in a sequential manner to a sun gear C 15*a* which is formed in the carrier C 15 serving as the final stage. The sun gear C 15*a* meshes with planet gears C 20 which are supported by support shafts 19*a* of a carrier 19 that transmits a torque to an output shaft 18, and which mesh with an internal gear C 21. The internal gear C 21 is rotatably housed in a gear case B 23, and shaped so as to have a plurality of claws 21*a* which extend in the axial direction from an end face on the side of the output shaft 18. In the gear case B 23, a plurality of through holes 23*b* which elongate in the axial direction of the gear case B 23 and in places which can correspond to the claws 21*a* of the internal gear C 21. A ball 22 which is engageable with the claws 21*a*, and a cylindrical roller 24 which is positioned between the ball 22 and a clutch plate 25 are housed in each of the through holes 23*b* so as to be movable in the axial direction of the gear case B 23.

The clutch plate 25 is always urged toward the internal gear C 21 by the urging force of a clutch spring 26 which will be described later. The balls 22 are always urged toward the internal gear C 21 via the clutch plate 25 and the rollers 24 to attain a state where the balls 22 are engaged with the claws 21*a* by the urging force.

The gear case B 23 has a cylindrical shape having at least two portions of different outer diameters. In the outer-diameter portion, the carrier 19, the internal gear C 21, and the like are housed, and the through holes 23*b* which accommodate the balls 22 and the rollers 24 are formed. In the smaller-diameter portion, the output shaft 18 is rotatably supported, and a male thread 23*a* is formed on the outer periphery.

A clutch member 27 having a female thread 27*a* which is to be screwed with the male thread 23*a* is disposed on the outer periphery of the smaller-diameter portion of the gear case B 23. The clutch member 27 is turned in conjunction with turning of a clutch ring 1 which is turned by an external operation. The clutch member 27 is moved in the axial direction of the gear case B 23 with being turned by means of the screw coupling of the male thread 23*a* and the female thread 27*a*. The clutch member 27 receives one end of the clutch spring 26 which is interposed between the member and the clutch plate 25, and is moved in the axial direction of the gear case B 23 while changing the axial dimension of the clutch spring 26. The outer wall portion of the clutch member 27 is shaped so as to guide the inner diameter portion of the coil spring 26.

As described above, when the clutch ring 1 is turned, the clutch member 27 is moved in the axial direction of the gear case B 23 to change the axial dimension of the clutch spring 26. Namely, the tool is structured so that the axial urging force by which the clutch spring 26 urges the clutch plate 25 can be adjusted.

When the electric power tool is to be used, the urging force of the coil spring 26 is adjusted to appropriately select the sliding torque. When a load which is larger than the selected sliding torque is applied to the output shaft 18, the claws 21*a* of the internal gear C 21 axially move the balls 22 against the urging force of the coil spring 26 and the internal gear C 21 begins to rotate, and hence the power transmission to the output shaft 18 is interrupted. Namely, the torque transmitted to the output shaft 18 can be controlled by adjusting the compression amount of the coil spring 26 as described above. The transmission of a large torque to the output shaft 18 can be attained by shortening the axial dimension of the clutch spring 26, i.e., by compressingly turning the clutch ring 1, and that of a small torque to the output shaft 18 can be attained by turning the clutch ring 1 so as to lengthen the axial dimension of the clutch spring 26.

In the case of a driver drill, it is required to obtain a state where the sliding torque is not set, i.e., the state of a drill mode. This state can be attained by a configuration in which the balls 22 are caused not to be axially moved, by means such as that of fully compressing the clutch spring 26, or that of butting a part of the clutch member 27 against the clutch plate 25, whereby the engagement between the claws 21*a* and the balls 22 is maintained to block the rotation of the internal gear C 21.

A plate spring 28 on which protrusions to be engaged with recesses of the clutch ring 1 are disposed is interposed between the clutch ring 1 and the gear case B 23 in order to allow the clutch ring 1 to be turned by an external force but inhibit the clutch ring 1 from being freely turned. In this way, restraint is imposed on the rotation direction in order to prevent the clutch ring 1 from being accidentally turned by the urging of the coil spring 26.

As described above, restraint is imposed on the rotation direction of the clutch ring 1, and, in an operation of selecting the fastening torque, the clutch ring 1 must be turned against the restraint, and hence an operation force of a certain degree is required. In a selecting operation in the case where the fastening torque is to be increased, the coil spring 26 is compressed, and therefore it is requested to exert an operation force of a larger degree. In order to enable the clutch ring 1 to be surely gripped, conventionally, a convex or concave shape for antislipping is formed in the circumferential direction on the outer peripheral face of the ring. In the case where the antislipping function is to be sufficiently exerted, the antislipping shape strongly acts on the palm because the shape is configured by the same hard synthetic resin as that of the base member, thereby producing a problem in that it is impossible to comfortably grip the ring.

SUMMARY OF THE INVENTION

The invention has been conducted in view of the above-mentioned circumstances. It is an object of the invention to provide an electric power tool which has a necessary and sufficient antislipping function, and which provides a gentle touch to the palm, i.e., in which the torque adjustment can be conducted surely and comfortably.

In order to attain the object, according to the present invention, there is provided an electric power tool in which an outer member has a plurality of projections discontinuously arranged on an outer peripheral face of a base member of a clutch ring, the outer member being lower in hardness than the base member.

In the electric power tool, the projections of the outer member are coupled to one another on a front side in an axial direction of the clutch ring.

In the electric power tool, the respective projections of the outer member are inclined with respect to a turning axis of the clutch ring.

In the electric power tool, a groove is formed in a surface of each the projection of the outer member, in parallel with a turning axis of the clutch ring.

In the electric power tool, the respective projections of the outer member radially project beyond the base member.

In the electric power tool, a rounded shape is formed in a projecting edge of each the projection of the outer member.

In the electric power tool, an annular member which is larger than a maximum outer diameter of the outer member is formed on an outer periphery of the base member to be integrated with the base member, and end portions of the projections of the outer member are inserted into the annular member.

DETAILED DESCRIPTION OF THE PREFERRED EMBODIMENTS

Figure 1:
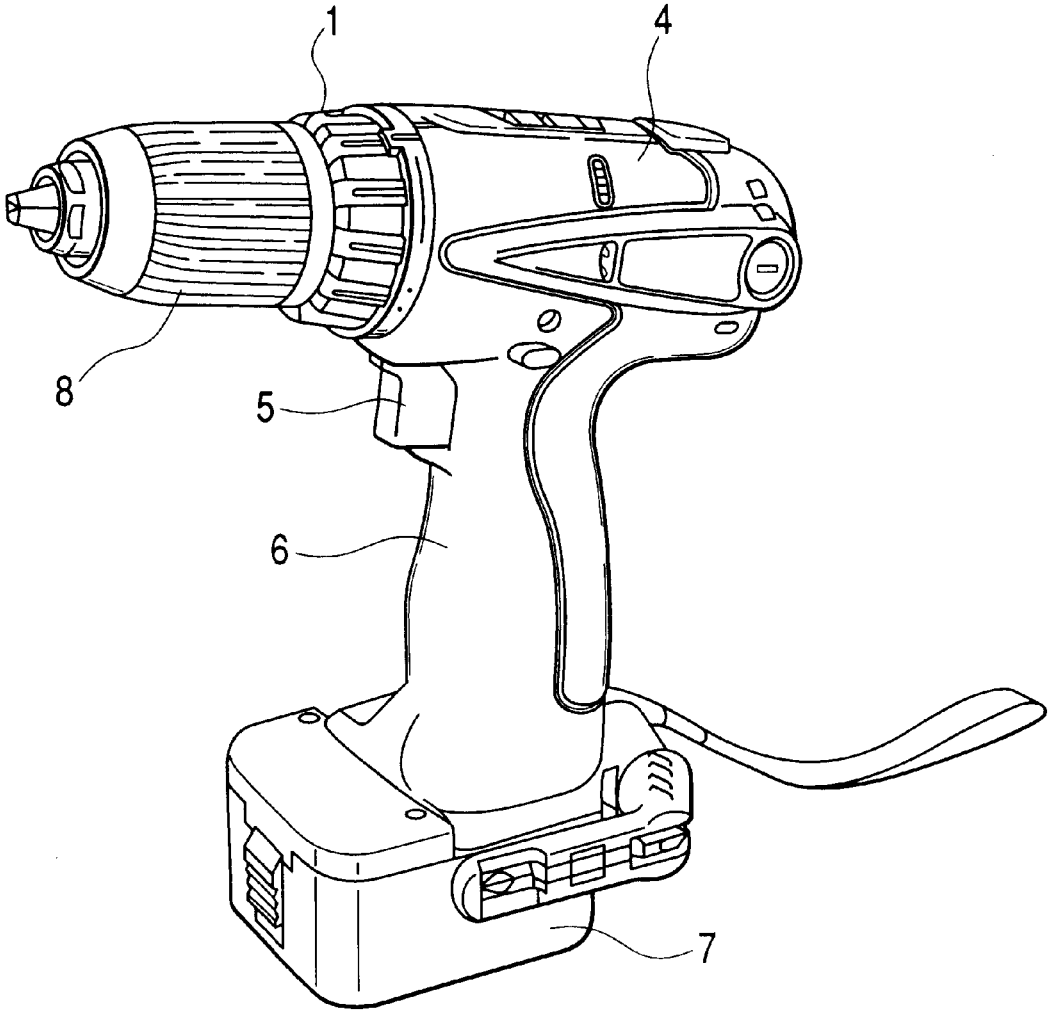
FIG. 1 is a perspective view showing an electric power tool according to an embodiment of the invention.
Figure 2:
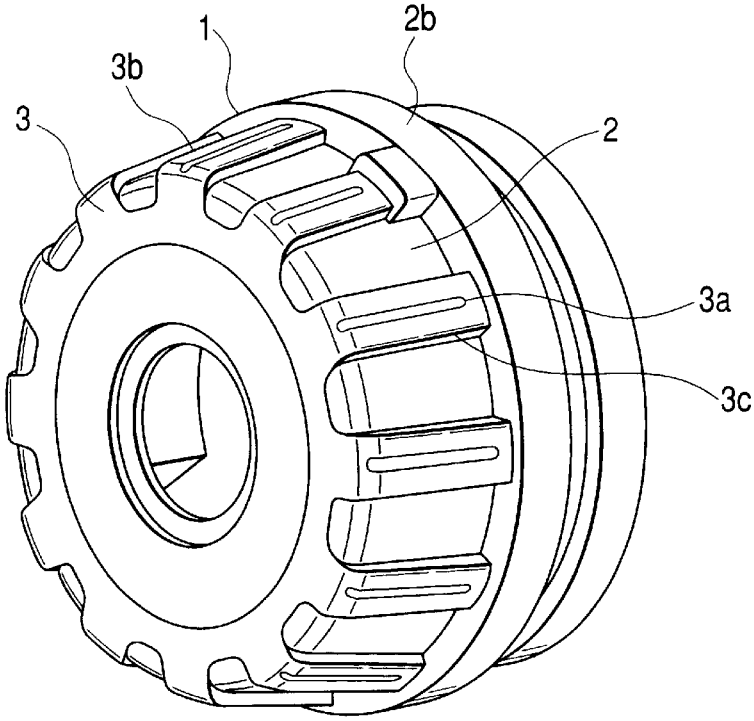
FIG. 2 is a perspective view showing a clutch ring constituting the electric power tool according to an embodiment of the invention.
Figure 3:
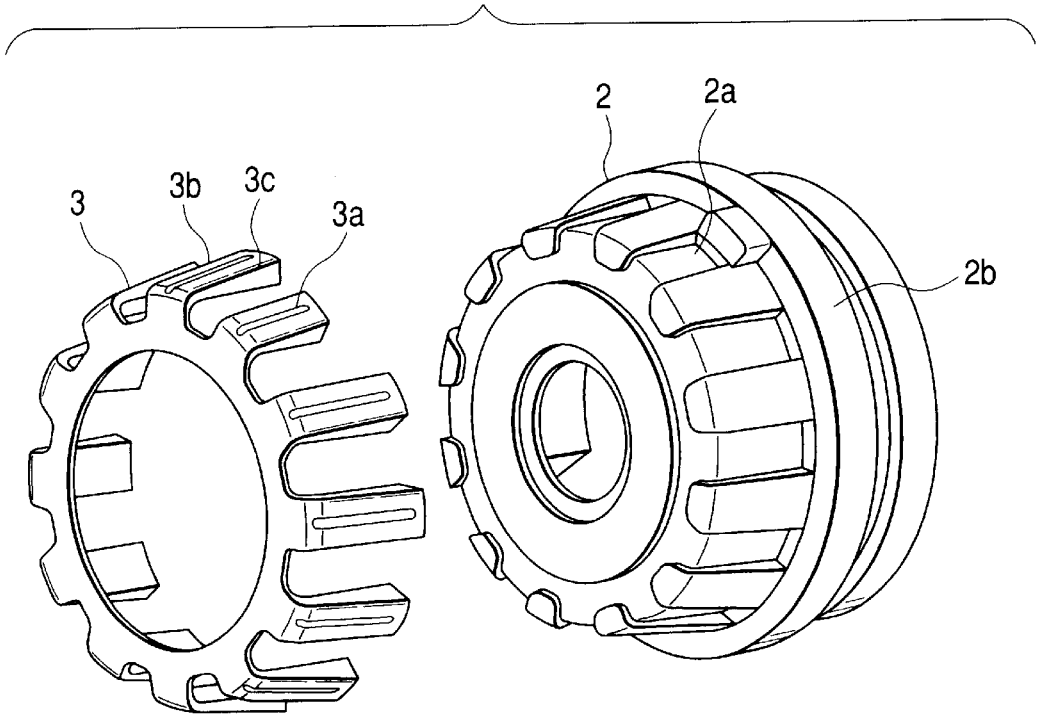
FIG. 3 is a development view of the clutch ring shown FIG. 2.
Figure 4:
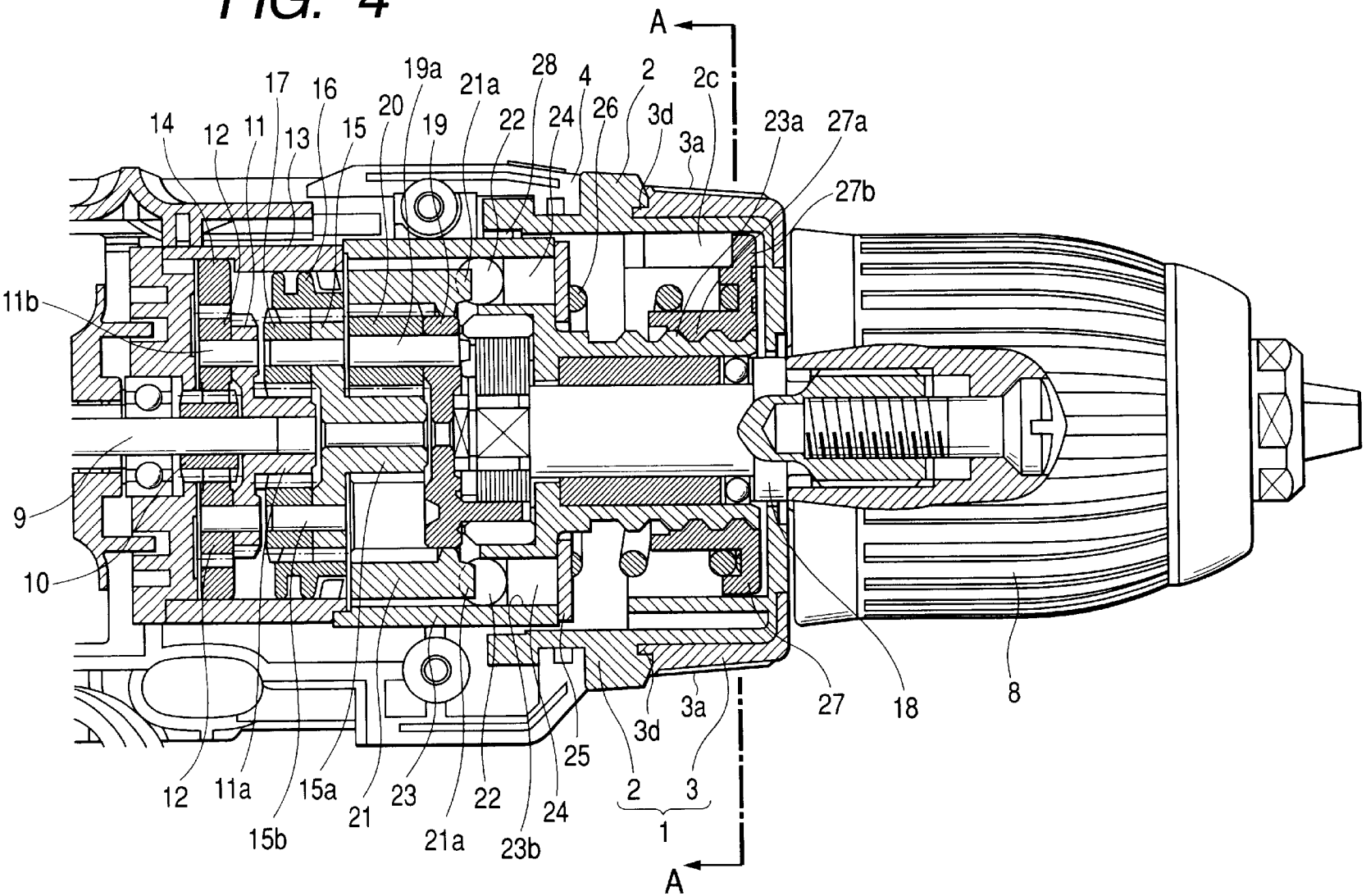
FIG. 4 is an enlarged section view of main portions of the electric power tool according to the embodiment of the invention.
Figure 5:
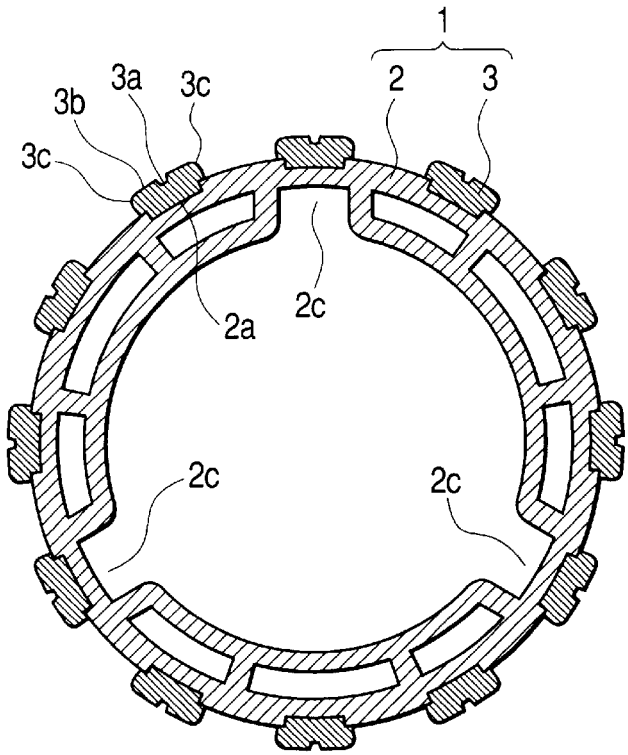
FIG. 5 is a section view showing the clutch ring constituting the electric power tool according to the embodiment of the invention, taken along the line A—A of FIG. 4.
Figure 6:
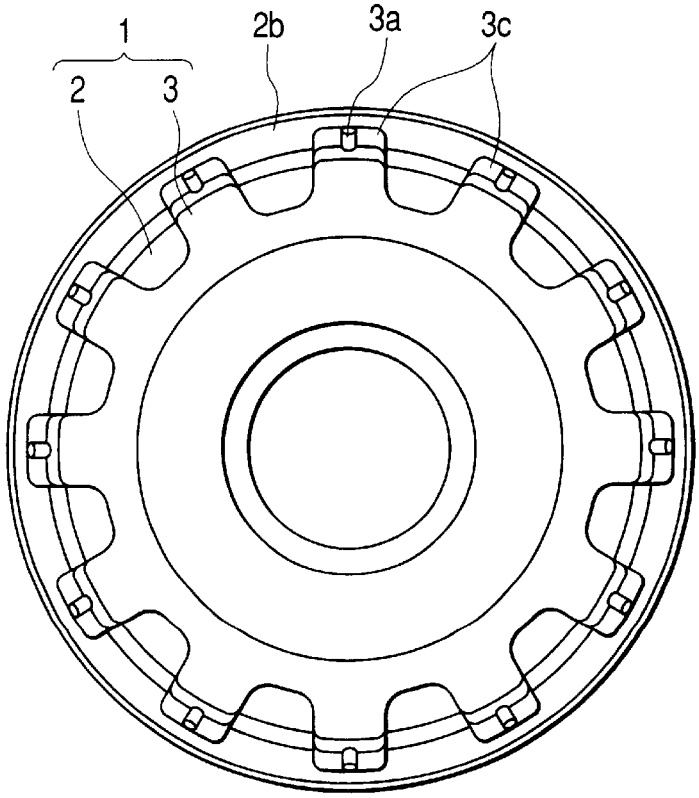
FIG. 6 is a left side view of the clutch ring shown in FIG. 2.
Figure 7:
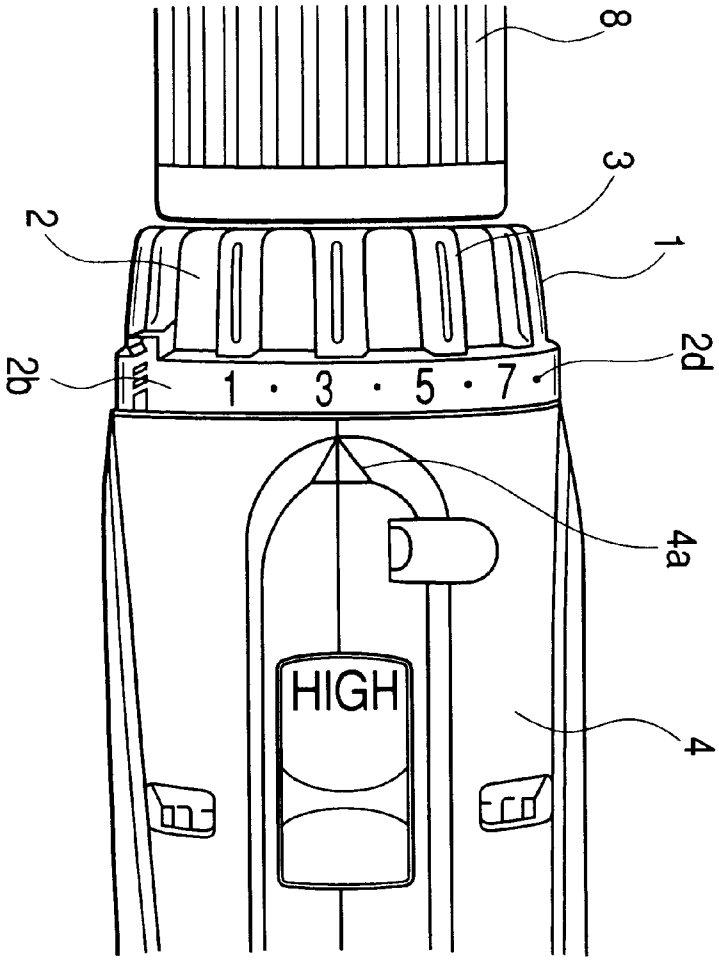
FIG. 7 is an enlarged plan view of main portions of the electric power tool according to the embodiment of the invention.
Figure 8:
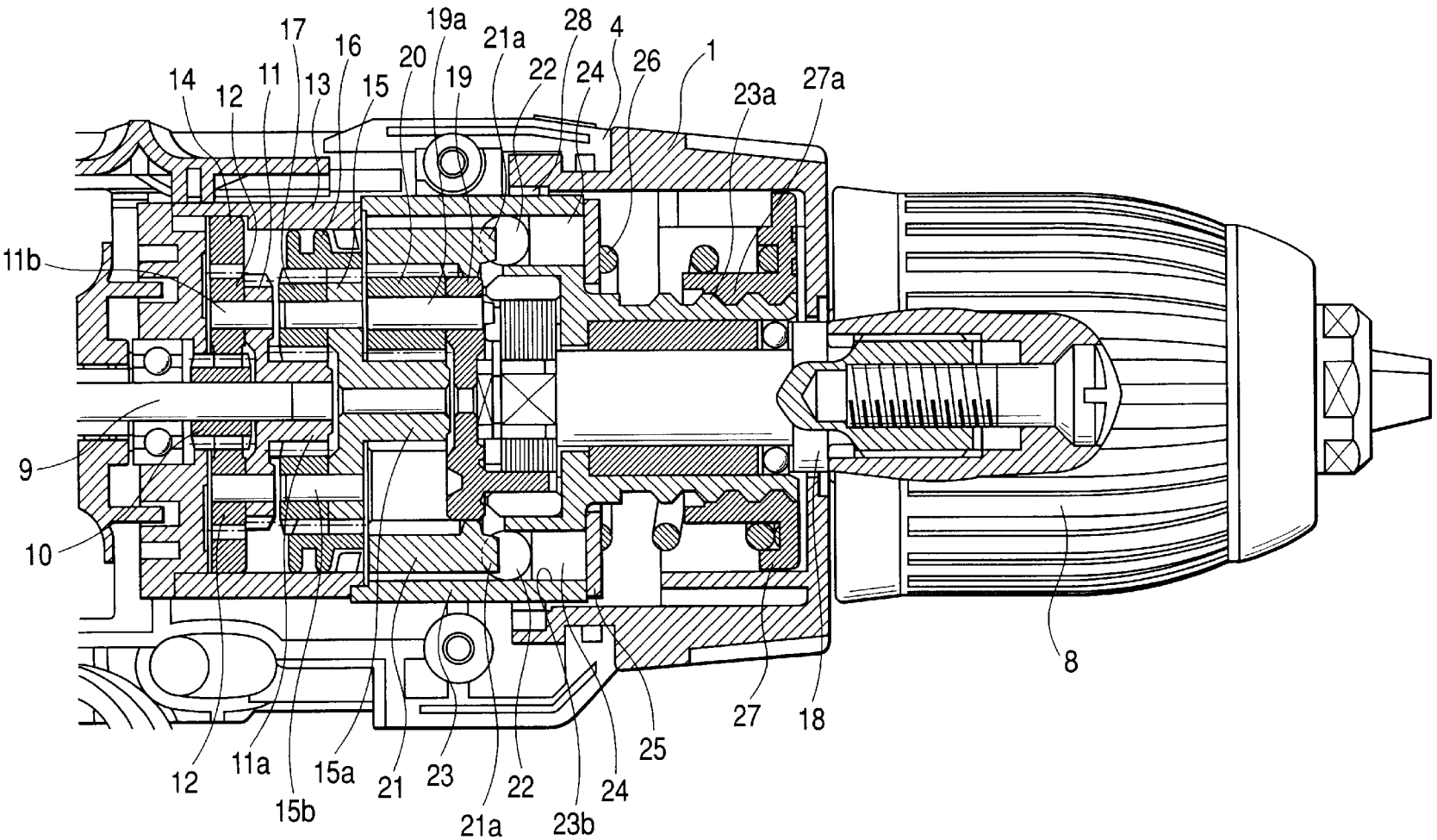
FIG. 8 is an enlarged plan view of main portions of a conventional electric power tool.

An embodiment of the electric power tool of the invention will be described with reference to FIGS. 1 to 7. FIG. 1 is a perspective view showing an embodiment of the electric power tool of the invention, FIG. 2 is a perspective view showing an embodiment of a clutch ring constituting the electric power tool of the invention, FIG. 3 is a development view of the clutch ring of FIG. 2, FIG. 4 is an enlarged section view of main portions and showing the embodiment of the electric power tool of the invention, FIG. 5 is a section view showing the embodiment of the clutch ring and taken along the line A—A of FIG. 4, FIG. 6 is a left side view of the clutch ring shown in FIG. 2, and FIG. 7 is an enlarged plan view of main portions and showing the embodiment of the electric power tool of the invention. The portions identical with those of the above-mentioned conventional electric power tool are denoted by the same reference numerals, and their description is omitted.

The electric power tool shown in FIG. 1 includes: a motor housing 4 which houses a motor not shown; and a handle 6 on which a switch 5 that controls the driving of the motor is disposed. A battery 7 serving as a driving source is detachably held by a lower portion of the handle 6. A tool holder 8 is disposed in front of the motor housing 4. A tool bit which is disposed substantially coaxially with the motor that is not shown, and which receives a rotational power from the motor to be rotated is attachable to and detachable to the tool holder. The clutch ring 1 which is rotatably supported on the motor housing 4 is disposed between the tool holder 8 and the motor housing 4.

As shown in FIGS. 2 to 7, the clutch ring 1 is configured by a base member 2, and an outer member 3 which is arranged in a part of the outer peripheral face of the base member 2. The base member 2 is made of a hard synthetic resin in which glass fibers are added to polycarbonate (PC). As shown in FIG. 5, three inner circumferential grooves 2*c* which are to be fittingly coupled with three protrusions 27*b* that radially protrude from the outer periphery of the clutch member 27 are formed in the inner periphery of the base member 2 to form a structure for turning the clutch member 27 in conjunction with the clutch ring 1. Twelve grooves 2*a* are formed in the outer periphery of the base member 2 at regular circumferential intervals, and twelve projections 3*b* of the outer member 3 are arranged so as to respectively fill the grooves 2*a*. The outer member 3 are made of a synthetic resin elastomer which is lower in hardness than the base member 2, and molded integrally with the base member 2 in a state where the base member is placed in molds for molding the outer members. Since the outer member 3 is integrally molded so as to fill the grooves 2*a* formed in the base member 2, the base member 2 and the outer member 3 are integrally bonded together, so that the outer members are prevented from separating from the base member during a process of operating the clutch ring 1.

As a result, the materials of different hardnesses, or the base member 2 and the outer member 3 are alternately arranged on the outer peripheral face of the clutch ring 1. When the clutch ring 1 is gripped in the operation of selecting the fastening torque, the palm sufficiently contacts with the outer member 3. Since the outer member 3 is made of the elastomer which exhibits rubber-like elasticity at ordinary temperature, the palm feels to a gentle touch, and a sufficient antislipping function can be obtained.

As shown in FIGS. 2, 3, and 6, in the embodiment, the projections of 3*b* of the outer member 3 are coupled to one another on the front side in the axial direction of the clutch ring 3. The configuration in which the projections 3*b* of the outer member 3 are coupled to one another in this way enables the outer member 3 to be molded as one body by one injection process. Therefore, the embodiment is practical because the number of gates for the injection molding can be reduced and also the mold costs can be reduced by simplifying the mold structure, whereby the production costs can be lowered. The place where the projections 3*b* of the outer member 3 are coupled to one another is not restricted to the outer side of the base member 2. The projections 3*b* of the outer member 3 may be coupled to one another inside the base member 2 and injection molded from the inner side without causing any difficulty.

In the embodiment, the projections 3*b* of the outer member 3 are inclined with respect to the turning axis of the clutch ring 1 so that their motor-side portions are positioned in a raidally outer side. Therefore, the clutch ring 1 can be gripped in the following manner. The thicker portion or the motor-side portion is gripped with the thumb and the index finger which can apply a larger force, and the thinner portion or the chuck-side portion is gripped with the fingers on the side of the little finger. In this gripping manner, a larger force can be easily applied, and the antislipping effect can be effectively attained.

A groove 3*a* which elongates in parallel with the turning axis of the clutch ring 1 is formed in the surface of each the projection 3*b* of the outer member 3. According to the configuration, when the clutch ring 1 is gripped, the palm contacts with the outer member 3 in a larger area, and hence the antislipping effect can be enhanced.

As shown in the figures, the outer member 3 has the plurality of projections 3*b* which project radially outward beyond the base member 2. According to the configuration, the palm contacts with the outer member 3 in a larger area, and hence the antislipping effect can be enhanced. Moreover, an edge of each of the projections 3*b* which project radially outward beyond the base member 2 is formed into a rounded shape 3*c,* and hence the palm feels to a gentler touch. As described above, restraint is imposed on the rotation direction of the clutch ring 1, and, in the operation of selecting the fastening torque, the clutch ring 1 must be turned against the restraint, and hence an operation force of a certain degree is required. In selecting operation in the case where the fastening torque is to be increased, the coil spring 26 is compressed, and therefore it is requested to exert a further operation force. Because of the projections 3*b* of the outer member 3 which projects beyond the base member 2, the operation force of rotating the clutch ring 1 can be easily transmitted to the clutch ring 1, so that the operability of the rotating operation on the clutch ring 1 can be improved. When the edges of the projections 3*b* are not formed into a rounded shape, a force which is applied from the palm during an operation of the clutch ring 1 is concentrated into the edges, and the edges may be damaged by the use for a long term to cause the outer member 3 to easily crack. By contrast, when edges of the projections 3*b* are formed into the rounded shape 3*c,* the force which is applied from the palm can be moderated, and hence the ring hardly cracks and its life period is prolonged.

In the embodiment, an annular member 2*b* which is larger than the maximum outer diameter of the outer member 3 is formed on the outer periphery of the base member 2 to be integrated with the base member 2, a protrusion 3*d* is formed on an end portion of each the projection of the outer member 3, and the protrusions 3*d* are embedded into the annular member 2*b*. According to the configuration, the bonding force between the base member 2 and the outer member 3 is further increased. Therefore, the outer members are prevented for a long term from separating from the base member during a process of operating the clutch ring 1. Namely, it is possible to provide a clutch ring which can be used for a longer term.

As shown in FIGS. 2, 3, and 4, in the end portion of the clutch ring 1 on the side of the tool holder 8, the outer member 3 does not project beyond the base member 2 toward the tool holder 8. During the operation of rotating the tool holder 8, therefore, the outer member 3 are prevented from contacting with the tool holder 8, and from separating from the base member 2. According to the configuration, even when an external force is applied to the end portion of the clutch ring 1 on the side of the tool holder 8, the outer member 3 can be prevented from separating from the base member 2.

As shown in FIG. 7, the annular member 2*b* of the base member 2 of the clutch ring 1 bears numerals and icons 2*d,* so that the numeral or icon pointed by a mark 4*a* formed on the motor housing 4 indicates the adjustment state of the fastening torque.

As described above, according to the invention, it is possible to provide an electric power tool which has a necessary and sufficient antislipping function, and which provides a gentle touch to the palm, i.e., in which the torque adjustment can be conducted surely and comfortably.

What is claimed is:

1. An electric power tool, comprising:

a clutch ring for adjusting a fastening torque; and an outer member having a plurality of projections discontinuously arranged on an outer peripheral face of a base member of said clutch ring, said outer member being lower in hardness than said base member.

2. The electric power tool according to claim 1, wherein the projections of said outer member are coupled to one another on a front side in an axial direction of said clutch ring.

3. The electric power tool according to claim 1, wherein the projections of said outer member are inclined with respect to a turning axis of said clutch ring.

4. The electric power tool according to claim 1, wherein a groove is formed in a surface of each of the projections of said outer member, in parallel with a turning axis of said clutch ring.

5. The electric power tool according to claim 1, wherein the projections of said outer member radially project beyond said base member.

6. The electric power tool according to claim 5, wherein a rounded shape is formed in a projecting edge of each of the projections of said outer member.

7. The electric power tool according to claim 1, wherein an annular member which is larger than a maximum outer diameter of said outer member is formed on an outer periphery of said base member to be integrated with said base member, and end portions of the projections of said outer member are inserted into said annular member.

* * * * *